US005819324A

United States Patent [19]

Bianco

[11] Patent Number: 5,819,324

[45] Date of Patent: Oct. 13, 1998

[54] TOILET VENTILATING DEVICE

[76] Inventor: Ronnie D. Bianco, 6120 Ridge Rd., Cortland, Ohio 44410

[21] Appl. No.: 881,590

[22] Filed: Jun. 24, 1997

Related U.S. Application Data

[60] Provisional application No. 60/023,261 Aug. 9, 1996.

[51] Int. Cl.[6] ..... E03D 9/04

[52] U.S. Cl. ..... 4/213

[58] Field of Search ..... 4/213, 216, 217

[56] References Cited

U.S. PATENT DOCUMENTS

| | | | |
|---|---|---|---|
| 2,309,774 | 2/1943 | Kistler | 4/213 |
| 2,685,094 | 8/1954 | MacAillo | 4/216 |
| 3,763,505 | 10/1973 | Zimmerman . | |
| 4,017,916 | 4/1977 | Pearson | 4/213 |
| 4,174,545 | 11/1979 | Smith, Jr. . | |
| 4,200,940 | 5/1980 | Buchanan . | |
| 5,010,600 | 4/1991 | Prisco . | |
| 5,345,617 | 9/1994 | Jahner et al. . | |
| 5,355,536 | 10/1994 | Prisco . | |
| 5,590,423 | 1/1997 | Boykin | 4/213 |

FOREIGN PATENT DOCUMENTS

| | | |
|---|---|---|
| 1291075 | 3/1969 | Germany . |
| 2143872 | 2/1985 | United Kingdom . |
| 2178456 | 2/1987 | United Kingdom . |
| 2247255 | 2/1992 | United Kingdom . |

*Primary Examiner*—Charles E. Phillips
*Attorney, Agent, or Firm*—Richard C. Litman

[57] ABSTRACT

A ventilation device for use with a standard toilet assembly commonly found in a household bathroom. The ventilation device includes a base which is mounted on the rim portion of the toilet bowl. A vacuum member having a hollow interior and containing a plurality of apertures is superimposed on the inner periphery of the base. A handle having a hollow interior is integrally formed with the vacuum member, and a connecting pipe is coupled to the free end of the handle. Suction devices are provided and operatively coupled to the connecting pipe in order draw odors from the toilet bowl and direct them to a remote location. The ventilation device may be used with multiple toilet assemblies via a common exhaust line. The device can also be adapted for use with various sizes of toilet assemblies.

12 Claims, 6 Drawing Sheets

TOILET VENTILATING DEVICE

CROSS-REFERENCE TO RELATED APPLICATION

This application claims the benefit of U.S. Provisional patent application Ser. No. 60/023,261, filed Aug. 9, 1996.

BACKGROUND OF THE INVENTION

1. Field of the Invention

The present invention relates generally to a toilet assemblies and more particularly to a ventilation device for removing odors from toilet assemblies.

2. Description of Related Art

A variety of arrangements have been devised for removing odor-producing gases from the space surrounding a toilet area. One approach has been the provision of a ventilating system incorporating the structure of the toilet seat assembly. Present trends in the design of toilets are tending toward structures of relatively well-proportioned units. Accordingly, there is a present need for a ventilating system that can be incorporated in modern integral units with a minimum of alterations to the standard components of a toilet assembly and require a minimum in the way of additional components.

Such ventilation systems are exemplified by the following patent documents. U.S. Pat. No. 3,763,505, issued on Oct. 9, 1973 to Zimmerman, describes a toilet bowl and a flush tank on the bowl in which an overflow pipe discharges overflow water into the toilet bowl and conducts obnoxious air and gases and odors from the toilet bowl into a ventilating system above the water level in the tank.

U.S. Pat. No. 4,174,545, issued on Nov. 20, 1979 to Smith, Jr., describes a ventilating device for a toilet wherein odorous air is withdrawn into a chamber to a filtering apparatus.

U.S. Pat. No. 4,200,940, issued on May 6, 1980 to Buchanan, describes a system wherein the odors are incinerated and the by-products are discharged back into the bathroom or to the outside atmosphere.

U.S. Pat. No. 5,010,600, issued on Apr. 30, 1991 to Prisco, describes a toilet odor removal system which draws the odors from the toilet seat area via an exhaust conduit connected to an existing bathroom exhaust fan.

U.S. Pat. No. 5,345,617, issued on Sep. 13, 1994 to Jahner et al. describes a toilet seat assembly having an aperture seat assembly for drawing in noxious toilet air, filtering and freshening the air and returning the treated air to the toilet area.

U.S. Pat. No. 5,355,536, issued on Oct. 18, 1994 to Prisco describes a ventilated toilet seat assembly wherein exhaust lines are connected to the ventilated toilet seat.

German Patent Document No. 1,291,075, dated Mar. 20, 1969 discloses a toilet seat with ventilating holes and an exhaust fan mounted at the rear of the toilet bowl.

U.K. Patent Document No. 2,143,872, dated Feb. 20, 1985 discloses a toilet assembly having a seat unit which includes vent holes.

U.K. Patent Document No. 2,178,456, dated Feb. 11, 1987 discloses an odor extractor apparatus which includes a hollow seat with vent holes.

U.K. Patent Document No. 2,247,255, dated Feb. 26, 1992 discloses a toilet seat having air extraction passages.

None of the above inventions and patents, taken either singly or in combination, is seen to describe the instant invention as claimed.

SUMMARY OF THE INVENTION

Accordingly, it is a principal object of the invention to provide a toilet ventilating kit.

It is another object of the invention to provide a toilet ventilating kit which can be adapted to various sizes and shapes of toilet assemblies.

It is a further object of the invention to provide a toilet ventilation system suited for use with multiple bathrooms.

Still another object of the invention is to provide a toilet ventilation kit which may be easily and efficiently manufactured and marketed.

It is an object of the invention to provide improved elements and arrangements thereof in an apparatus for the purposes described which is inexpensive, dependable and fully effective in accomplishing its intended purposes.

In accordance with the objects of the invention, a ventilation kit is provided for use with a standard toilet assembly commonly found in a household bathroom. The ventilation kit includes a base which is mounted on the rim portion of the toilet bowl. A vacuum member having a hollow interior is superimposed on the inner periphery of the base member. Once properly positioned, the vacuum member extends over the upper and lower surfaces of the base. The vacuum member contains a plurality of apertures disposed on its lower surface. A handle having a hollow interior has a first end integrally formed with the vacuum member, and a second end which is free. A connecting pipe is then coupled to the second end of the handle. Suction means are provided and operatively coupled to the connecting pipe in order to draw odors from the toilet bowl and direct them to a remote location.

In accordance with another object of the invention, a toilet ventilation system is provided which is easily adaptable for use with multiple toilets in a household. The system includes a ventilation device associated with each toilet assembly in the house. Each ventilation device is subsequently coupled to an exhaust line which is disposed behind the bathroom wall. Suction means are coupled to the exhaust line in order to draw odors from any or all of the toilet bowls and direct them to a remote location.

In preferred embodiments of the invention, an exhaust fan is used to draw air from the toilet bowls and direct them to a remote location such as an attic or outside of the house. Furthermore, the exhaust fan may be coupled to lighting circuitry of one or all of the bathrooms so that activation of the light will also result in activation of the exhaust fan. The base of the ventilation kit or system may also be provided with a plurality of adhesive tabs which facilitate adjustment and placement on various sizes and shapes of toilet bowls.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
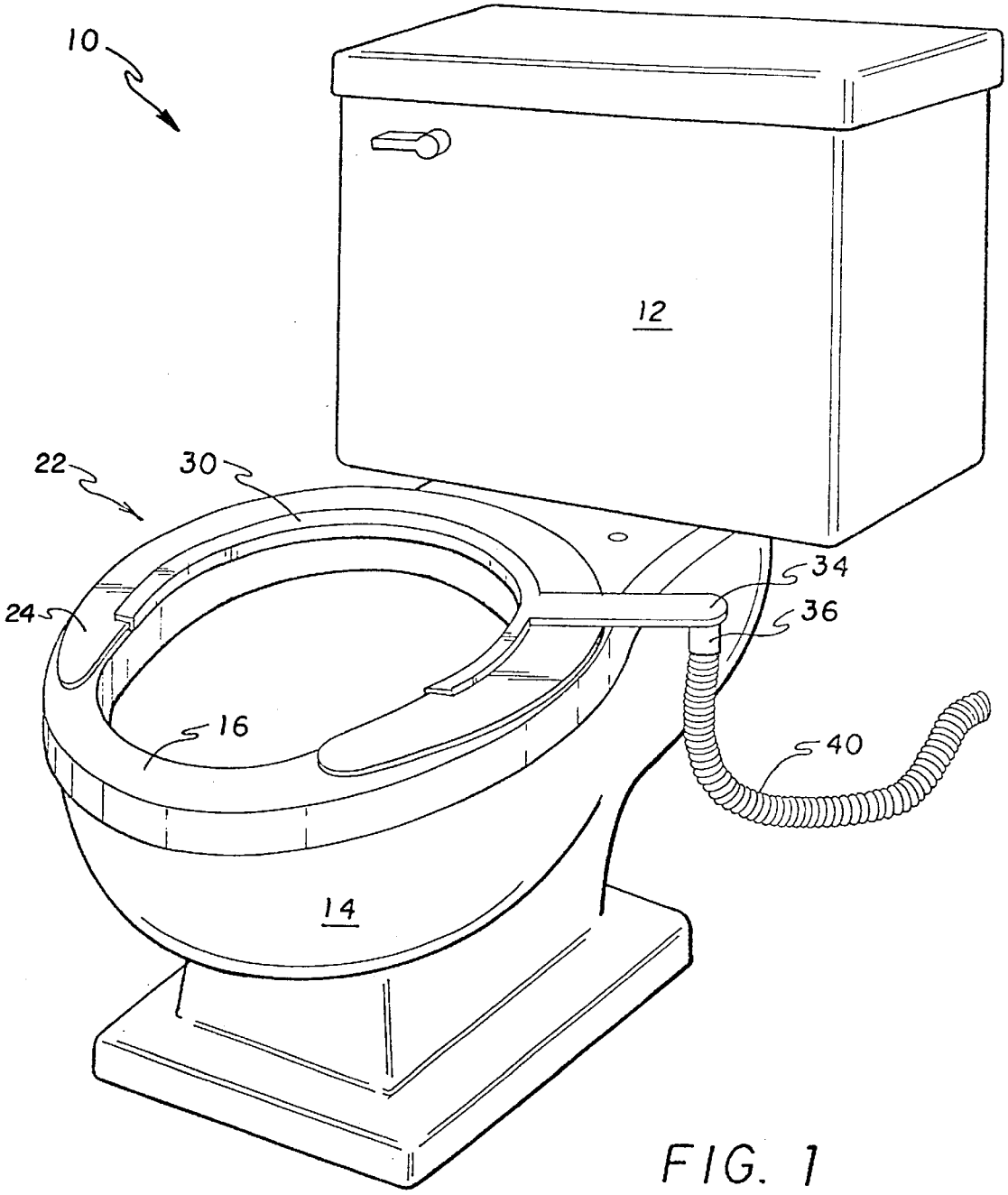
FIG. 1 is a perspective environmental view of a toilet ventilation device in accordance with the present invention.
Figure 2:
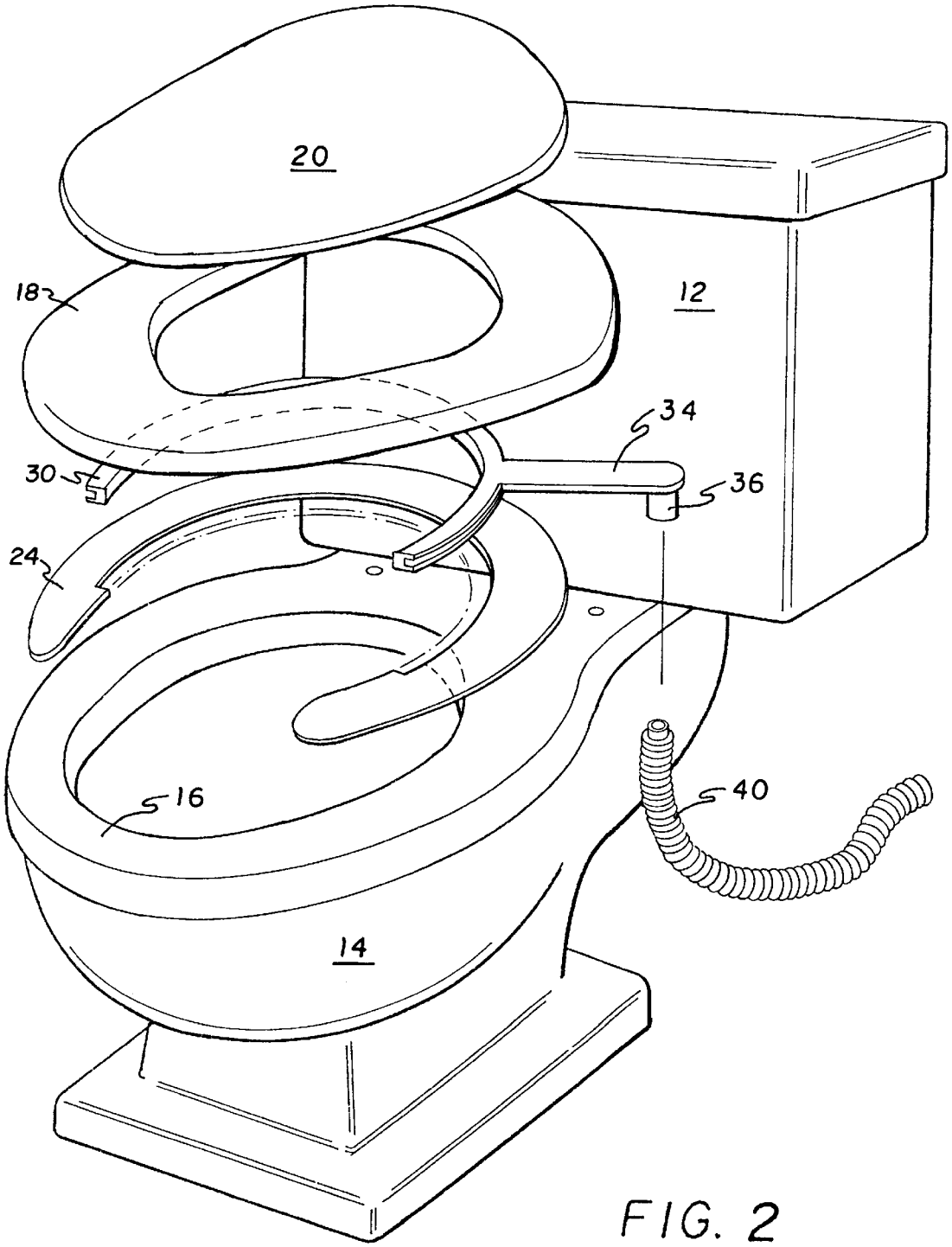
FIG. 2 is an exploded vies of the toilet ventilation device.

Referring to the drawings and initially to FIGS. 1 and 2 thereof, a toilet assembly 10 is shown which incorporates a ventilation device 22 in accordance with the present invention. The toilet assembly 10 shown in FIG. 1 is illustrative of those commonly found in a household bathroom. Referring particularly to FIG. 2, the toilet assembly 10 includes a reservoir 12 which is used to store water. The reservoir 12 sits on top of, and is operatively coupled to a toilet bowl 14 having a hollow interior and a rim portion 16. A toilet seat 18 and a seat cover 20 are positioned above the rim portion 16 and hingedly coupled to the toilet bowl 14.

Figure 4:
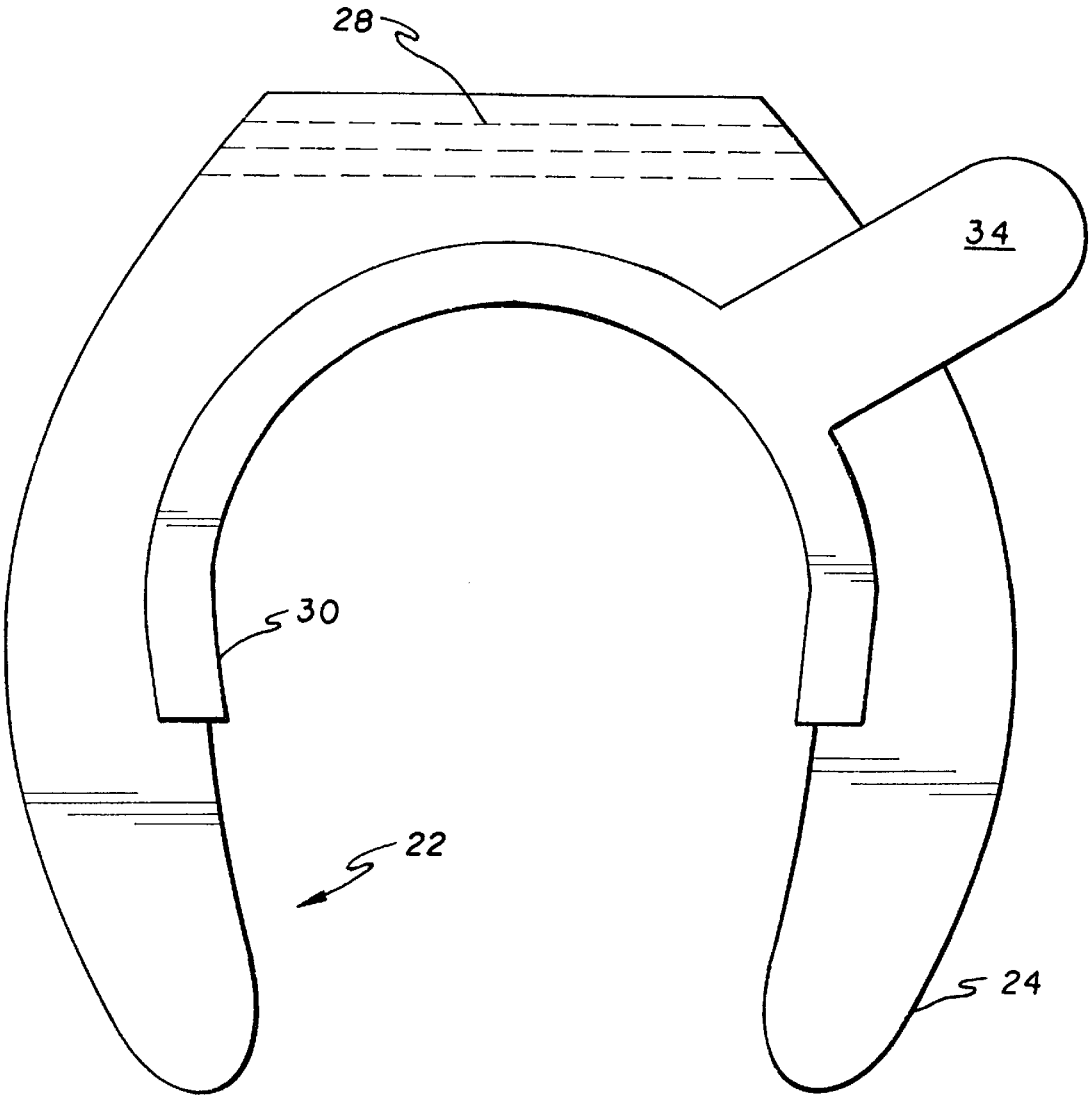
FIG. 4 is a top plan view of the toilet ventilation device.
Figure 5:
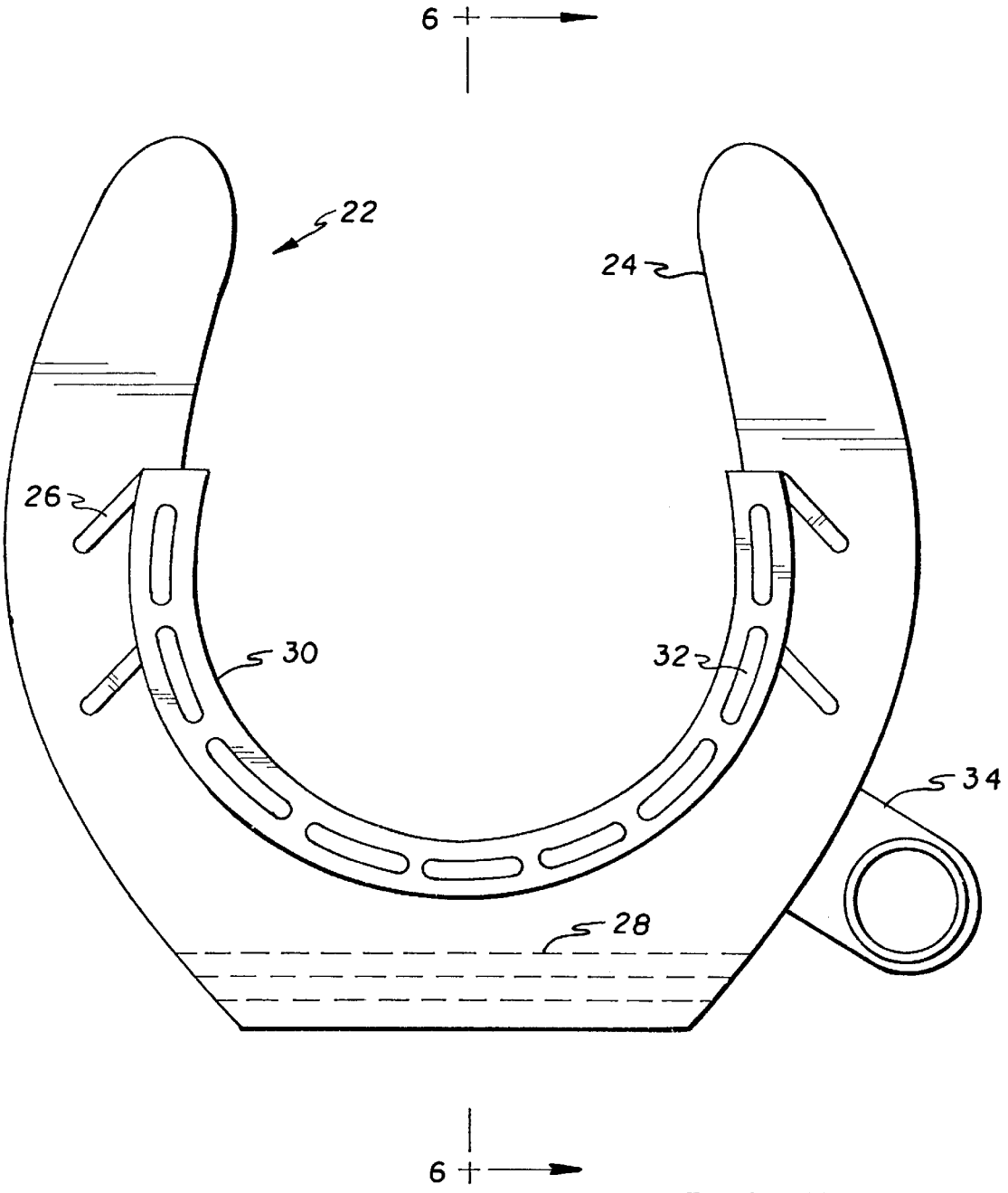
FIG. 5 is a bottom plan view of the toilet ventilation device.
Figure 6:
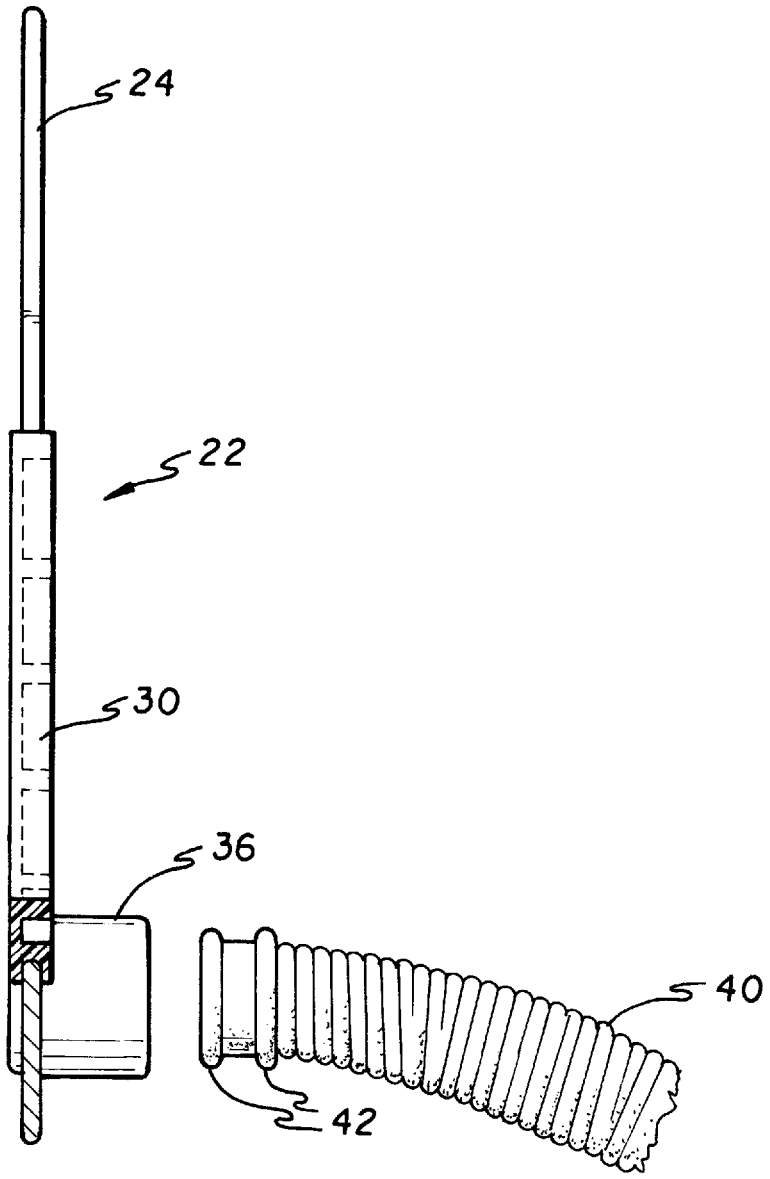
FIG. 6 is a cross-sectional side view of the base of the ventilation device taken along line 6—6 of FIG. 5 and looking in the direction of the arrows.

The ventilation device 22 includes a base 24 which is appropriately sized and dimensioned for mounting on the rim portion 16 of the toilet bowl 14. A vacuum member 30 having a hollow interior is superimposed on the inner periphery of the base 24. As seen in FIG. 6, the vacuum member 30 has a C-shaped cross-section which facilitates superimposition on the inner periphery of the base 24. The vacuum member 30 is manufactured of two molded pieces, snap-fit together to form the required hollow interior. Once properly positioned, the vacuum member 30 extends over the upper and lower surfaces of the base 24, as seen in FIGS. 4–6. With continued reference to FIG. 5, the vacuum member 30 is seen to contain a plurality of apertures 32 disposed on its lower surface to facilitate the suction of odoriferous vapors from the toilet assembly. A plurality of tabs 26 are disposed to the side surfaces of vacuum member 30. Since toilet assemblies 10 come in various sizes, the rear portion of the base 24 includes a plurality of perforations 28 which allow removal of various sized sections in order to correspond to the size of the particular toilet assembly 10 being used.

Referring back to FIGS. 1 and 2, the ventilation device 22 includes a handle 34 having a first end integrally formed with the vacuum member 30, and a second end which is free. The handle 34 has a hollow interior which is in registry with the hollow interior of the vacuum member 30, thereby forming a continuous passageway. A connecting pipe 36 is coupled to the second end of the handle, while a flexible hose 40 is coupled at one end to the connecting pipe 36. With additional reference to FIG. 6, the flexible hose 40 includes a plurality of extensions 42 disposed on the outer periphery of each end (only one shown) The connecting pipe 36 also includes a plurality of recesses (not shown) designed to matingly engage the extensions on the flexible hose 40.

Figure 3:
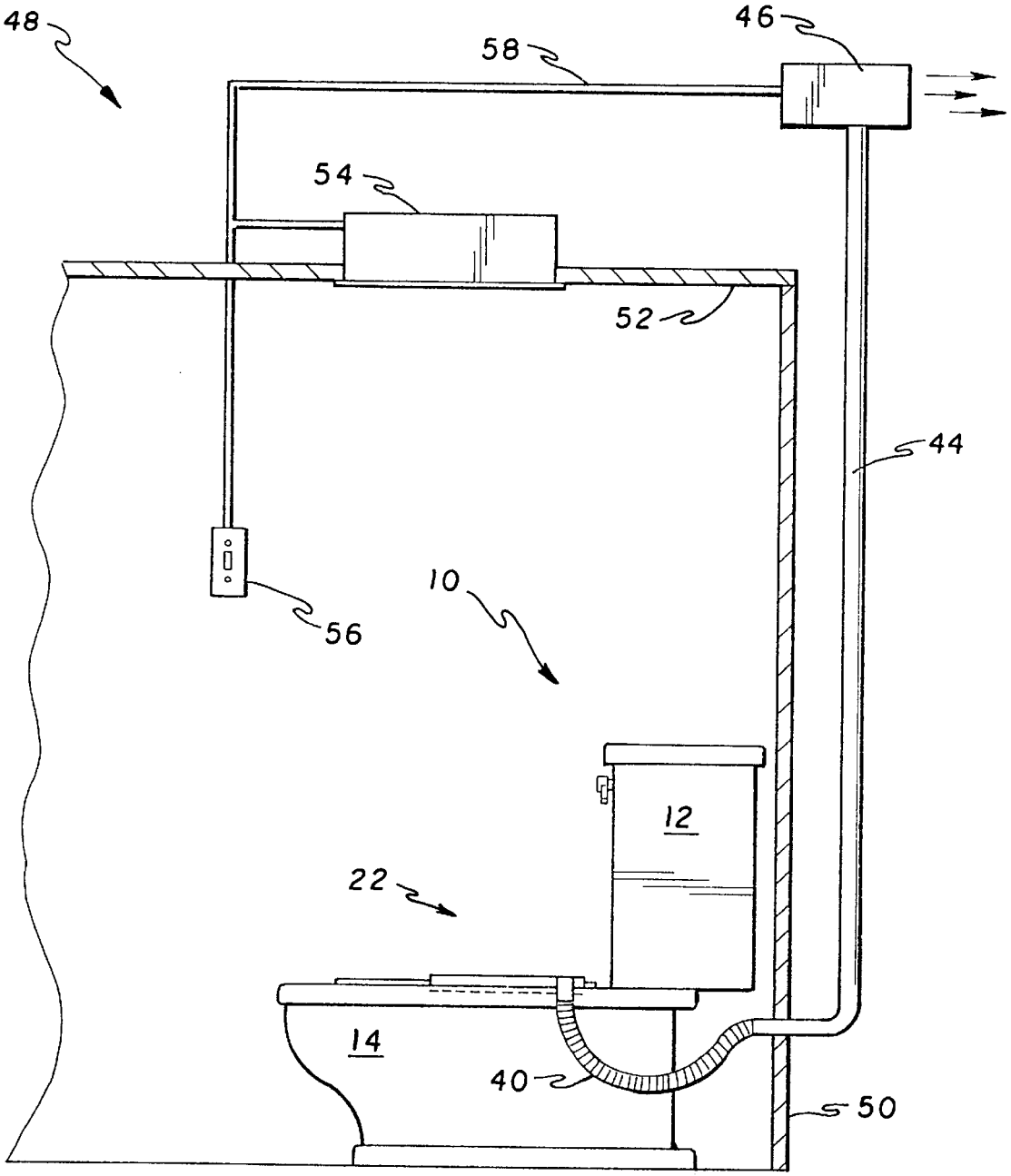
FIG. 3 is a partial side elevational view of a bathroom illustrating placement and attachment of the components of the toilet ventilation device.

Turning now to FIG. 3, a cutaway view of a typical bathroom 48 is shown to illustrate removal of odors from the toilet assembly 10. An exhaust line 44 is disposed behind one of the walls 50 of the bathroom 48. The exhaust line 44 is common 1-¼ or 2 inch PVC pipe, and has an output which is at a location remote from the bathroom 48. Accordingly, it is preferred that the exhaust line 44 be positioned as close to the toilet assembly 10 as possible. As previously mentioned, each end of the flexible hose 40 includes a plurality of extensions 42 thereon. Accordingly, the flexible hose 40 is capable of engaging the input of the exhaust line 44, simply by drilling an appropriately sized hole into line 44 and inserting an extension 42.

An exhaust fan 46 is coupled to the output of the exhaust line 44 in order to suction odors from the toilet assembly 10. The exhaust fan 46 may be positioned in an attic or similar unused location in the house. Alternatively, the exhaust fan 46 may be mounted at a location where the air removed from the toilet assembly 10 can be directed outside the house. It is well known that typical bathrooms 48 include a ceiling 52 upon which a light fixture 54 is mounted. The light fixture 54 can be selectively activated by a light switch 56 when a person enters the bathroom 48. Wiring 58 is commonly used to place the light fixture 54 in electrical communication with the light switch 56. The exhaust fan 46 can be coupled to the same wiring 58 so that ventilation of the toilet assembly 10 is initiated upon activation of the light fixture 54.

It should be readily appreciated by those skilled in the art that the ventilation device 22 of the present invention may be used in conjunction with multiple toilet assemblies 10. In such an arrangement, the exhaust line 44 would be provided with a plurality of inputs which corresponds to the number of toilet assemblies 10 available. The flexible hose 40 of each toilet assembly 10 would then be coupled to an associated input of the exhaust line 44. The electric circuitry could be provided such that activation of the light fixture 45 in any of the bathrooms 48 results in the activation of the exhaust fan 46.

Various modifications may be made to the present invention. As previously mentioned, multiple toilet assemblies 10 can be coupled to a common exhaust line 44 and a subsequent exhaust fan 46. Furthermore, a three-way electrical switch could be utilized in place of the light switch 56. In such an arrangement, the exhaust fan 46 could be selectively activated independent of the light fixture 54. The exhaust line 44 can be routed to a basement, an attic, or external location. The ventilation device 22 can be made of various sturdy and lightweight materials such as plastic. Finally, the ventilation device 22 provides flexibility by allowing a user to appropriately size the base 24 by cutting the rear portion along a desired perforation 28.

It is to be understood that the present invention is not limited to the embodiments described above, but encompasses any and all embodiments within the scope of the following claims.

I claim:

1. A ventilation kit for use with a bathroom having a plurality of walls, a light switch, and a toilet assembly including a toilet bowl having a rim portion, a toilet seat, a toilet seat cover, and a reservoir containing water therein, the ventilation kit comprising:

a base sized and configured for mounting on the rim portion of the toilet bowl, said base having an upper surface, a lower surface and an inner periphery;

means for securing said base to the rim portion;

a vacuum member having a C-shaped cross-section with a lower surface, an upper surface, and a hollow interior, said vacuum member being superimposable upon said inner periphery of said base, said vacuum member further containing a plurality of apertures disposed on the lower surface thereof;

a handle having a first end integrally formed with said vacuum member and a second end, said handle containing a hollow interior in registry with the hollow interior of said vacuum member;

a connecting pipe coupled to the second end of said handle; suction means;

means for selectively activating and deactivating said suction means; and means for operatively coupling said suction means to said connecting pipe.

2. A ventilation kit as recited in claim 1 wherein said means for securing said base comprises a plurality of tabs disposed on the lower surface of said base, said tabs being suited for adhesion to the rim portion of the toilet bowl.

3. A ventilation kit as recited in claim 1 wherein said suction means comprises a remotely positioned exhaust fan.

4. A ventilation kit as recited in claim 1 wherein said means for selectively activating and deactivating comprises wiring operatively coupling said suction means to the light switch of the bathroom so as to activate said suction means upon entering the bathroom and deactivate said suction means upon exiting the bathroom.

5. A ventilation kit as recited in claim 1 wherein said means for operatively coupling said suction means comprises:

an exhaust line disposed behind one of the walls proximate the toilet assembly, said exhaust line having a first end positioned proximate the toilet assembly and a second end coupled to said suction means; and a flexible hose having a first end coupled to said connecting pipe, and a second end coupled to the first end of said exhaust line.

6. A ventilation kit as recited in claim 5 wherein said flexible hose includes a plurality of circumferentially disposed extensions at the first and second ends thereof, and wherein said connecting pipe and the first end of said exhaust tube each contain a plurality of recesses equal in number to said plurality of circumferentially disposed extensions, said plurality of recesses being dimensioned for engaging said circumferentially disposed extensions.

7. A toilet ventilation system comprising:

(a) at least one toilet assembly, each of said at least one toilet assembly including:

a toilet bowl including a rim portion, a toilet seat positionable above said rim portion, a toilet seat cover positionable above said toilet seat, means for hingedly coupling said toilet seat and said toilet seat cover to said rim portion, and a reservoir containing water therein, said reservoir being operatively coupled to said toilet bowl;

(b) ventilation means associated with each of said at least one toilet assembly, said ventilation means including:

a base appropriately sized and configured for mounting on the rim portion of said toilet bowl, said base having an upper surface, a lower surface, and an inner periphery, means for securing said base to said rim portion, a vacuum member having a C-shaped cross-section with a lower surface, an upper surface, and a hollow interior, said vacuum member being superimposable upon the inner periphery of said base member, said vacuum member further containing a plurality of apertures disposed on the lower surface thereof, a handle having a first end integrally formed with said vacuum member and a second end, said handle containing a hollow interior in registry with the hollow interior of said vacuum member, and a connecting pipe coupled to the second end of said handle;

(c) suction means;

(d) means for selectively activating and deactivating said suction means; and (e) means for operatively coupling said suction means to said connecting pipes.

8. A toilet ventilation system as recited in claim 7 wherein said means for securing said base comprises a plurality of tabs disposed on the lower surface of said base, said tabs being suited for adhesion to the rim portion of said toilet bowl.

9. A toilet ventilation system as recited in claim 7 wherein said means for securing said base comprises a securing portion extending from said base, said securing portion being alignable with said means for hingedly coupling, and said securing portion further including a plurality of perforations for appropriately sizing said base in correspondence with the rim portions of various sizes of toilet bowls.

10. A toilet ventilation system as recited in claim 7 wherein said suction means comprises a remotely positioned exhaust fan.

11. A toilet ventilation system as recited in claim 7 wherein said means for operatively coupling said suction means comprises:

an exhaust line disposed behind one of the walls proximate each of said at least one toilet assembly, said exhaust line including a plurality of inputs equal in number to said at least one toilet assembly and an output coupled to said suction means; and a flexible hose associated with each of said at least one toilet assembly, each of said flexible hoses having a first end coupled to an associated one of said connecting pipes, and a second end coupled to one of the inputs of said exhaust line.

12. A toilet ventilation system as recited in claim 11 wherein each of said flexible hoses includes a plurality of circumferentially disposed extensions at the first and second ends thereof, and wherein each of said connecting pipes and each of the inputs of said exhaust line contain a plurality of recesses equal in number to said plurality of circumferentially disposed extensions, said plurality of recesses being dimensioned for engaging said circumferentially disposed extensions.

* * * * *